US005239814A

United States Patent [19]

Yamada et al.

[11] Patent Number: 5,239,814

[45] Date of Patent: Aug. 31, 1993

[54] CREEL MECHANISM FOR A RING SPINNING FRAME PROVIDED WITH DISPLACEABLE ROVING GUIDES

[75] Inventors: Koichi Yamada, Ama; Kenji Sasaki, Komaki, both of Japan

[73] Assignee: Howa Machinery, Ltd., Aichi, Japan

[21] Appl. No.: 795,780

[22] Filed: Nov. 21, 1991

[30] Foreign Application Priority Data

Nov. 29, 1990 [JP] Japan ..... 2-336302

[51] Int. Cl.[5] ..... D01H 9/14; D01H 13/04

[52] U.S. Cl. ..... 57/278; 57/90; 57/276; 57/281; 57/352; 57/353; 242/131

[58] Field of Search ..... 57/90, 281, 276, 278, 57/266, 352, 353, 358, 359, 360; 242/131, 131.1

[56] References Cited

U.S. PATENT DOCUMENTS

| | | | |
|---|---|---|---|
| 2,945,639 | 7/1960 | Bohannon | 242/131 |
| 4,408,731 | 10/1983 | Schenkel | 57/352 X |
| 4,657,205 | 4/1987 | Sugioka | 57/358 X |
| 4,827,709 | 5/1989 | Schoeller et al. | 57/268 X |
| 4,905,929 | 3/1990 | Turton | 242/157 R X |
| 4,942,729 | 7/1990 | Guttler et al. | 57/359 X |

FOREIGN PATENT DOCUMENTS

| | | | |
|---|---|---|---|
| 0068120 | 1/1983 | European Pat. Off. . | |
| 0213962 | 3/1987 | European Pat. Off. . | |
| 0287788 | 10/1988 | European Pat. Off. . | |
| 1098419 | 9/1959 | Fed. Rep. of Germany | 242/131 |
| 1244630 | 7/1967 | Fed. Rep. of Germany | 57/352 |
| 1-52828 | 2/1989 | Japan . | |
| 2-38500 | 8/1990 | Japan . | |
| 593200 | 8/1975 | Switzerland | 242/131 |
| 2072714 | 10/1981 | United Kingdom | 57/352 |

*Primary Examiner*—Daniel P. Stodola
*Assistant Examiner*—William Stryjewski
*Attorney, Agent, or Firm*—Stevens, Davis, Miller & Mosher

[57] ABSTRACT

In a ring spinning frame provided with two parallel alignments of bobbin hangers, a plurality of roving guides is arranged in an alignment at an intermediate position between the two alignments of bobbin hangers, wherein a first group of roving guides is formed by roving guides alternately positioned in the roving guide arrangement and a second group of roving guides is formed by the remained roving guides thereof, an improved creel mechanism for relatively displacing the first group of roving guides and the second group of roving guides whereby a first intervening space between two adjacent roving guides and a second intervening space between two adjacent roving guides are alternately formed along the alignment of the roving guides, wherein the first intervening space ensures a free passage of a full packaged roving bobbin but the second intervening space does not permit a free passage of the full packaged roving bobbin, the above-mentioned formation of two intervening spaces being created alternately, at each intervening space between two adjacent roving guides, by the reciprocal motion of the displacing mechanism.

5 Claims, 10 Drawing Sheets

CREEL MECHANISM FOR A RING SPINNING FRAME PROVIDED WITH DISPLACEABLE ROVING GUIDES

BACKGROUND OF THE INVENTION

1. Field of the Invention

The present invention relates to a creel mechanism of a ring spinning frame provided with conventional mechanism except the creel mechanism, more particularly an improvement of the creel mechanism of the conventional ring spinning frame.

2. Description of the Related Art

Japanese Unexamined Patent Publication Sho 64 (1989)-52828 discloses a unique creel mechanism applied to a conventional ring spinning frame provided with a plurality of draft parts arranged at each side thereof, wherein two alignments of bobbin hangers are arranged along the longitudinal direction of said ring spinning frame, a plurality of roving guides, each provided with two hook-shaped guide elements, are arranged in an alignment at an intermediate position between said two alignments of said bobbin hangers, in parallel thereto, so that rovings from roving bobbins supported by corresponding pair of said bobbin hangers, one of which is a bobbin hanger of a backside alignment of said two alignments of bobbin hangers and the other is a corresponding bobbin hanger of a front side alignment of said two alignments of bobbin hangers, facing the above-mentioned front bobbin hanger, and each roving guide member is connected to a solid portion of the creel mechanism by way of a flexible element such as a spring. Accordingly, each roving guide member can be displaced from the standby position coinciding to the above-mentioned intermediate position by coming into contact with a full packaged bobbin, which is being displaced to the corresponding back bobbin hanger, without applying a positive bending force, and of returning from the displaced position to the standby position after the above-mentioned insertion of the full packaged roving bobbin.

Japanese Examined Patent Publication Hei 2 (1990)-38500 discloses another type of creel mechanism of the conventional ring spinning frame wherein two alignments of bobbin hangers arranged in the same condition as the first mentioned prior art and a plurality of flat roving guide members, each provided with a pair of hooked shaped guide elements, arranged at an intermediate position between the above-mentioned two alignments of bobbin hangers, and said two roving guide elements of each roving guide member are arranged along a direction perpendicular to the lengthwise direction of the ring spinning frame.

In the first mentioned prior art, however, since the two roving guide elements of each roving guide member are parallel to the alignments of the bobbin hangers, at the time of each unit operation of the roving bobbin exchange operation, wherein two almost exhausted roving bobbins supported by two adjacent bobbin hangers of the backside alignment of the bobbin hangers are simultaneously exchanged with full packaged roving bobbins, respectively, when the full packaged roving bobbins are to be simultaneously exchanged with the corresponding almost exhausted roving bobbins supported by the two adjacent bobbin hangers of the backside alignment, each of the full packaged roving bobbins must pass through a space between two adjacent roving guides. This space, however, is not sufficient to allow a free passage therethrough of a full packaged roving bobbin, and thus the outside surface of the full packaged roving bobbin is forced into contact with the roving guide members and pushes the roving guides against the resilient force of the spring element of the roving guide, and accordingly, the possibility of an abrasion of the outside roving layer of the full packaged roving bobbin by the roving guide members is created, and the outside roving layer of the full packaged roving bobbin may be damaged In addition to the above-mentioned problem, it is also necessary to cover the spring elements with a cover piece, to prevent a possible deposition of free fibers on the spring elements The second mentioned prior art has the following problem, i.e., since the intervening distance between two adjacent roving guide members is double the spindle pitch, the diameter of the full packaged roving bobbin is slightly smaller than the above-mentioned intervened space, e.g., 7 mm in a normal condition of the spinning operation. Therefore, to ensure a free passage of the full packaged roving bobbin through the above-mentioned space when carrying out the roving bobbin exchange operation, it is necessary to use a flat shaped roving guide member having a precise thickness and the roving guide members must be carefully arranged to maintain a uniform intervening space, to thereby guarantee the free passage of the full packaged roving bobbins between the respective two adjacent roving guide members. In our experience, however, it is evident that the preparation of such roving guide members having a precise uniform thickness, and the above-mentioned precise arrangement of the roving guide members, is very difficult, and therefore, it is apparent that the second mentioned prior art is not practical.

SUMMARY OF THE INVENTION

Therefore, the object of the present invention is to provide an improved creel mechanism by which the above-mentioned problems can be solved. To attain the above-mentioned object, in the present invention, an improved creel mechanism by which, when a full packaged roving bobbin is required to pass through an intervening space between two adjacent roving guides towards a corresponding bobbin hanger of the back alignment thereof, any possible interference by the above-mentioned roving guides is eliminated. That is, in a ring spinning frame provided with a plurality of draft parts arranged at each side thereof, a front alignment of bobbin hangers for supporting the respective roving bobbins and a back alignment of bobbin hangers for supporting respective roving bobbins arranged at each side thereof in parallel along the lengthwise direction of the spinning frame, a plurality of roving guides arranged at an intermediate position between the above-mentioned two alignments of bobbin hangers, wherein the known system of arranging roving bobbins characterized by a two-step tapered arrangement of roving bobbins is applied, and a mechanism for relatively changing the intervening space between two adjacent roving guides is adopted.

Therefore, before the roving bobbin exchange operation is carried out for each pair of almost exhausted roving bobbins held by the respective bobbin hangers, one of which is the bobbin hanger of the back alignment, while the other one is the bobbin hanger of the front alignment and faces the above-mentioned back bobbin hanger, before the full packaged roving bobbin is displaced to the above-mentioned back bobbin hanger, the intervening space between two adjacent roving guide corresponding to the bobbin hangers is enlarged by relatively displacing the above-mentioned two roving guides by the action of the displacing mechanism mentioned above. Accordingly, each full packaged roving bobbin can be freely displaced through the above-mentioned intervening space between the corresponding two adjacent roving guides, and thus any possible damage to the full packaged roving bobbin due to a possible contact with the roving guides can be satisfactorily prevented.

DESCRIPTION OF THE PREFERRED EMBODIMENTS

The mechanism and function of the improved creel mechanism applied to a ring spinning frame provided with two alignments of bobbin hangers, i.e., the two-step tapered arrangement of roving bobbins, according to the present invention is hereinafter explained with reference to the attached drawings.

Figure 3:
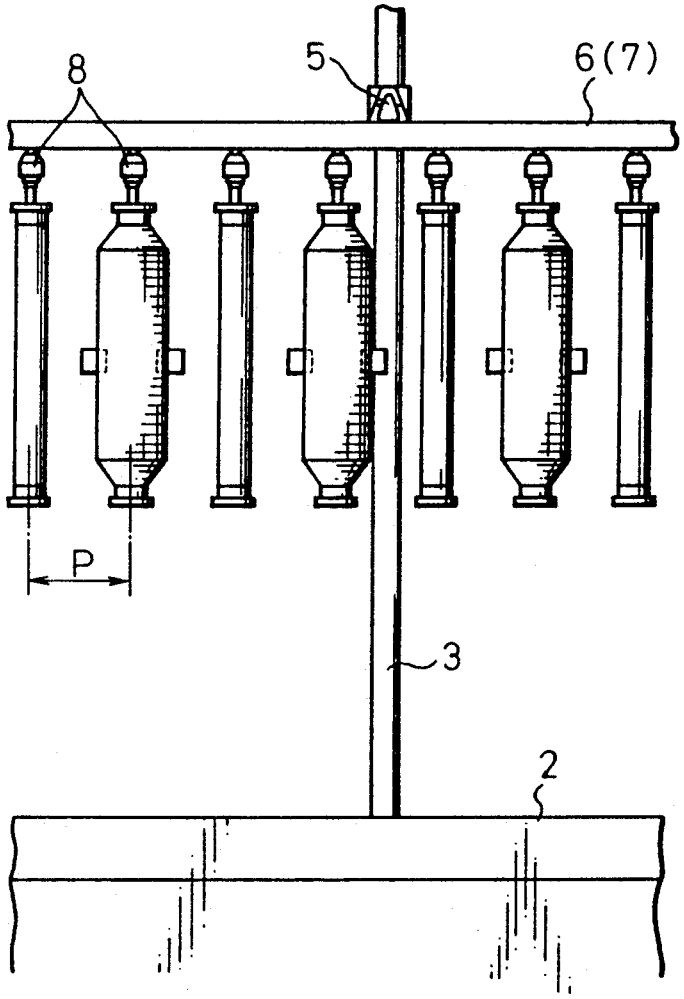
FIG. 3 is a side view of a creel portion of a ring spinning frame shown in FIG. 4, wherein a supplemental rail is omitted.
Figure 4:
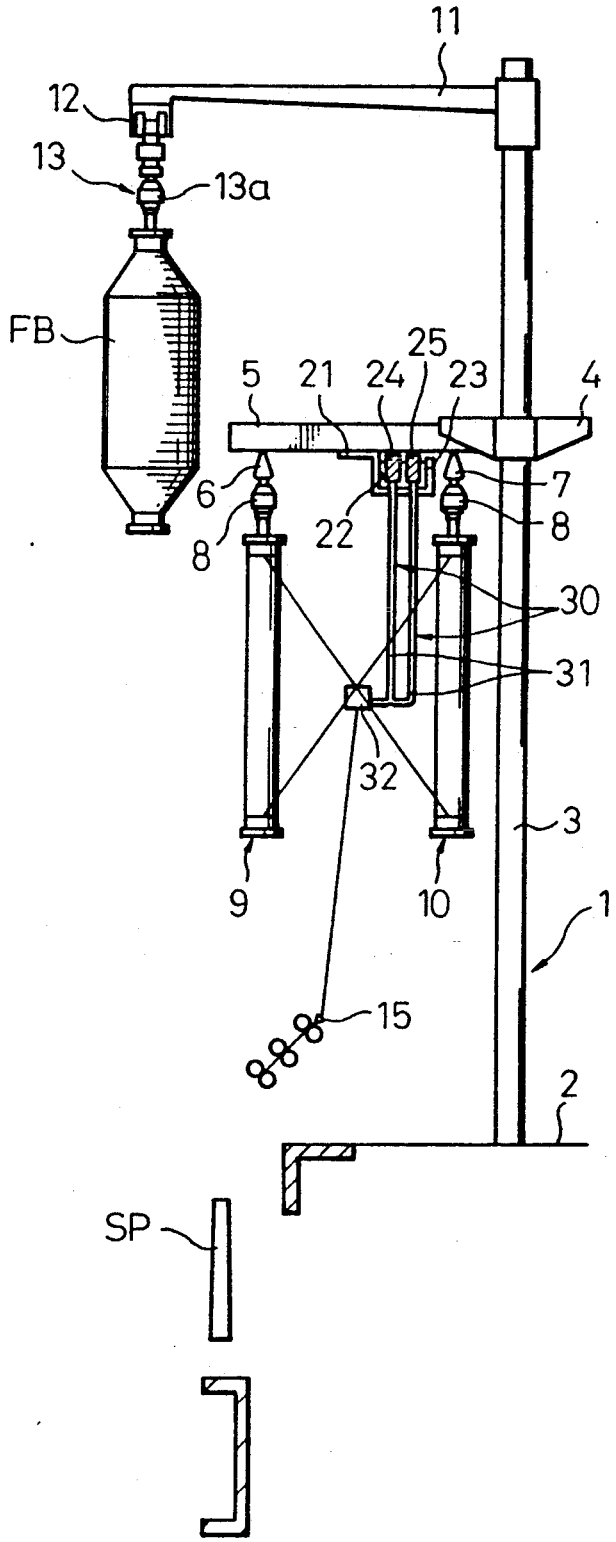
FIG. 4 is a partly omitted cross sectional side view of a ring spinning frame.

As shown in FIGS. 3 and 4, a plurality of vertical pillars 3 are rigidly mounted on a machine frame 2 of a ring spinning frame 1 in an alignment along the lengthwise direction thereof. A horizontal supporting bracket 4 is secured at an intermediate position of each vertical pillar 3 and a horizontal creel bar bracket 5 secured to the supporting bracket 4 is extended outwards from the bracket 4 at each side of the spinning frame 1. A pair of creel bars 6 and 7, each having a respective length extended for the entire length of the creel portion, are rigidly supported by the creel bar brackets 5 at respective positions therebelow in parallel and along the lengthwise direction of the spinning frame 1. A plurality of bobbin hangers 8, which number is ½ of the total number of spindles SP at each side of the spinning frame 1, are rigidly supported by each one of the creel bars 6 and 7, such that an identical intervened pitch P is provided between two adjacent bobbin hangers 8 of each creel bar in a condition such that a vertical imaginary plane, involving an axis of a bobbin hanger 8 of the creel bar 6 and an axis of a bobbin hanger 8 of the creel bar 7 facing the above-mentioned bobbin hanger 8 of the creel bar 6, is perpendicular to the lengthwise direction of the spinning frame. The above-mentioned pitch P is double that of the spindle pitch. To simplify the following explanation, the bobbin hangers 8 of the creel bar 6 and the bobbin hangers 8 of the creel bar 7 are hereinafter referred to as the front bobbin hanger 8 and the back bobbin hangers 8 respectively, and the back bobbin hanger 8 facing the above-mentioned front bobbin hanger 8 are hereinafter referred to as a pair of facing bobbin hangers "PB". A horizontal rail bracket 11 extended to both sides of the ring spinning frame 1 is rigidly secured to the top of each vertical pillar 3, and a supplemental rail 12 is rigidly secured to the free end portion of the horizontal brackets 11 at each side of the spinning frame in parallel to the lengthwise direction of the spinning frame 1. The supplemental rail 11 has a function of temporarily receiving a bobbin carriage 13 provided with a plurality of bobbin hangers for supporting full packaged roving bobbins, displaced from a roving room, and for discharging the bobbin carriage 13 having almost exhausted roving bobbins, by way of the above-mentioned bobbin hangers, therefrom. The bobbin carriage 13 is provided with plurality of bobbin hangers 13*a* in a condition such that a pitch between two adjacent bobbin hangers 13*a* is identical to the pitch between two adjacent pairs of facing bobbin hangers "PB". In practice, full packaged roving bobbins FB are carried to the supplemental rail 12 before carrying out the roving bobbin exchange operation, by displacing the bobbin carriage 13 to the supplemental rail 12, so as to useful for carrying out the roving bobbin exchange operation with respect to either one of the front alignment 9 of the roving bobbins and the back alignment 10 of the roving bobbins.

Figure 5:
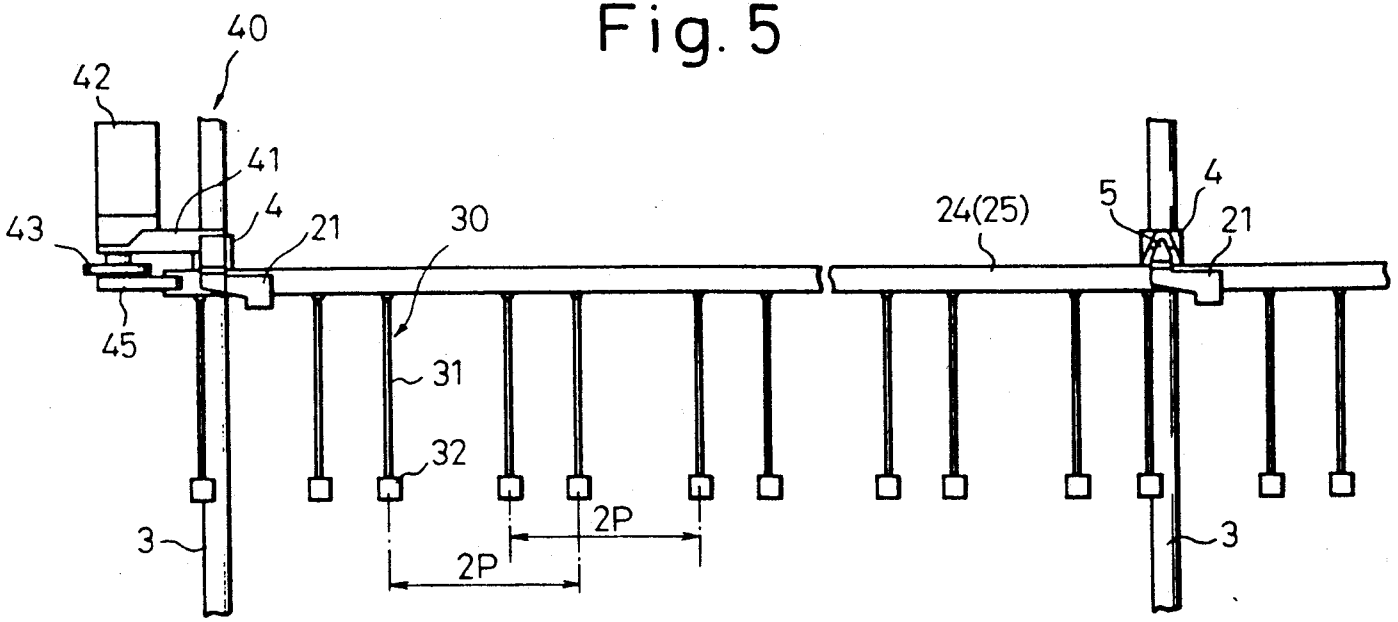
FIG. 5 is a front view of the creel mechanism shown in FIG. 1.

As shown in FIGS. 4 and 5, a metal bracket 21 is secured to a bottom surface of each creel bar bracket 5. The metal bracket 21 is provided with a rectangular recessed portion 22 opened upwards, and slide bar supporting metals 23 are disposed in the rectangular recessed portion 22. A pair of slide bars 24 and 25 are slidably disposed in the respective spaces between two adjacent slide bar supporting metals 23 in a condition such that these slide bars 24 and 25 extend in parallel to the lengthwise direction of the spinning frame 1. Each one of the slide bars 24 and 25 occupies the space covering the front alignment 9 of the roving bobbins and the back alignment 10 of the roving bobbins, and each one of slide bars 24 and 25 is provided with a plurality of roving guides 30, to a number identical to one half of the total number of spindles arranged at each side of the spinning frame, rigidly mounted thereon with a pitch between two adjacent roving guides 30 of each alignment thereof which is double the pitch "P" between two adjacent pairs of facing bobbin hangers "PB".

Figure 1:
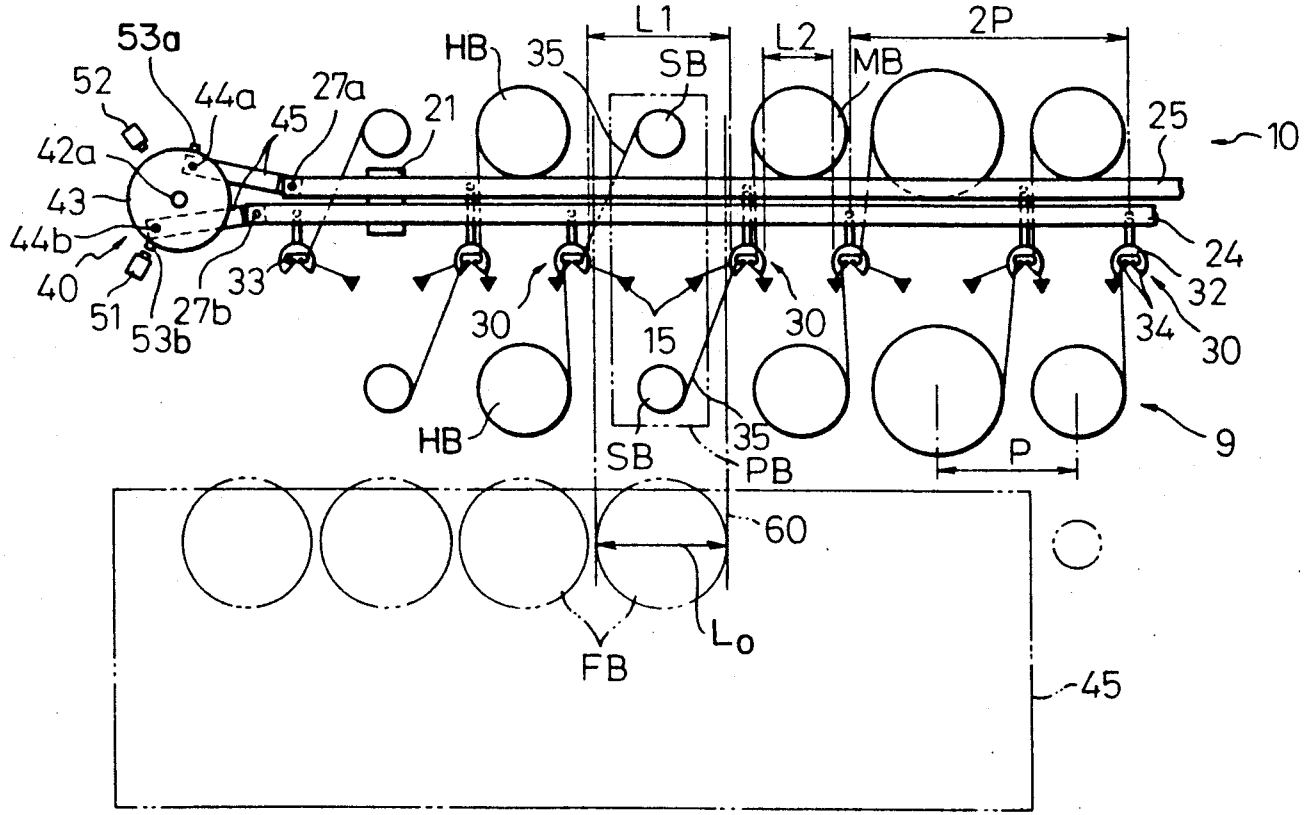
FIG. 1 is a plan view of an embodiment of the creel mechanism of the present invention.
Figure 2:
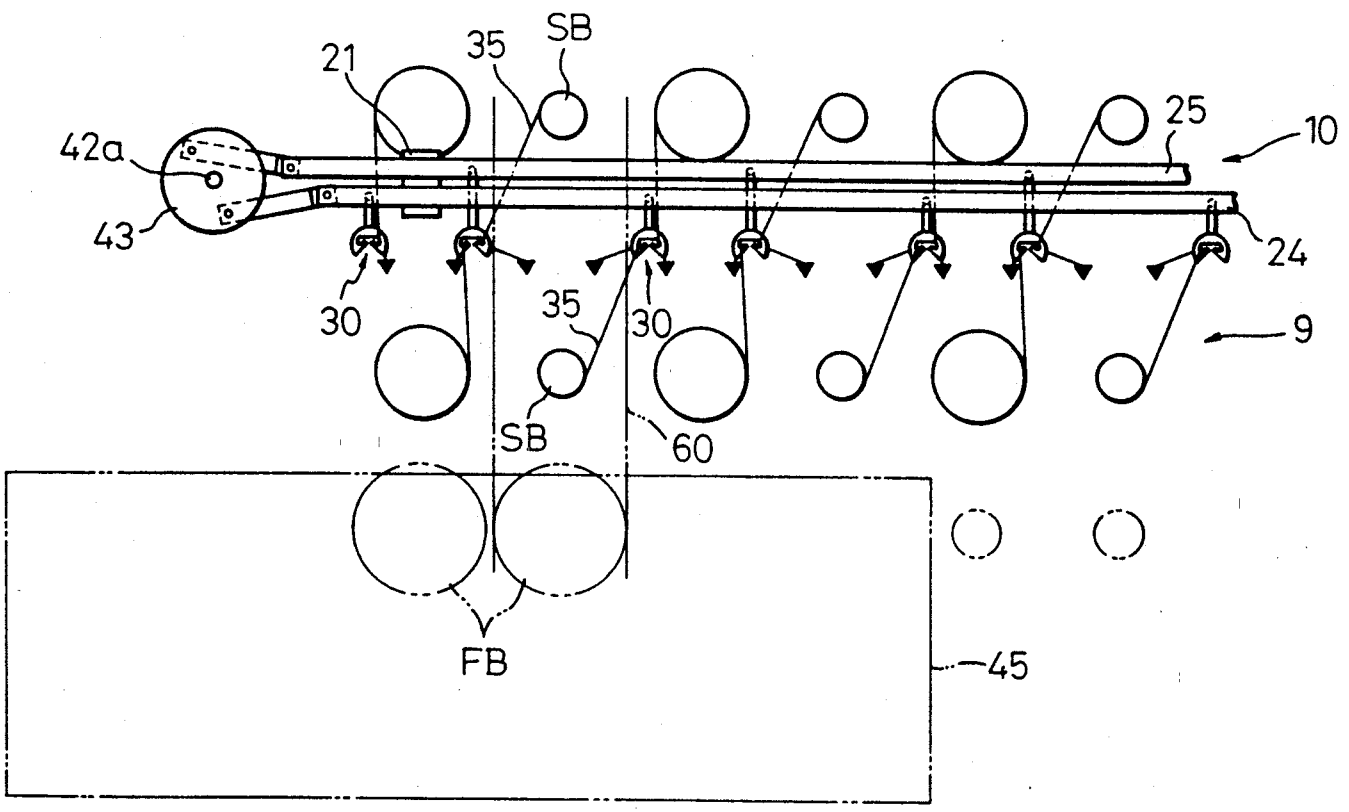
FIG. 2 is a plan view of the creel mechanism shown in FIG. 1, in a condition that the mechanism is actuated.

Each roving guide 30 is provided with a guide head 32 secured to a tip portion of a L-shaped supporting rod 31, the top end of which is secured to either one of the slide bars 24 and 25. As shown in FIG. 1, in the alignment of the roving guides 30, the roving guides 30 are alternately secured to the side bars 24 and 25. As shown in FIG. 4, the position of the head 32 of each roving guide 30 is designed to occupy an intermediate position between a front alignment 9 of the roving bobbins and a back alignment 10 of the roving bobbins in a condition such that each roving guide 30 is positioned in a space between two adjacent pairs of facing bobbin hangers "PB".

The guide head 32 of each roving guide 30 is provided with a cutout portion having a semi-circular shape, and a pair of projected engaging portions 34 are engaged with the center of the above-mentioned cutout portion, formed at both terminals of the cutout portion, one of the projected engaging portions 34 of each guide head 32 functioning to guide a roving supplied from the roving bobbin supported by a front bobbin hanger 8 of a pair of facing bobbin hangers "PB" to a trumpet 15 of a corresponding draft part, and the other of the projected engaging portions 34 functioning to guide a roving supplied from the roving bobbin supported by a back bobbin hanger 8 of an adjacent pair of facing bobbin hangers "PB", to a trumpet 15 of a corresponding draft part of the spinning frame 1. The shape of the projected engaging portion 34 can be modified and can be made in a shape of a hook.

A mechanism 40 for relatively displacing the slide bars 24 and 25 along the alignment of the roving guides 30 is disposed at an end portion of the spinning frame 1, and the ends of the slide bars 24 and 25 are connected to the displacing mechanism 40. That is, in the displacing mechanism 40, a motor bracket 41 is rigidly mounted on a supporting bracket 4 of the creel bracket 5 rigidly supported by the creel pillar 3 disposed at an end portion of the spinning frame 1, for example, an end portion in the proximity of a gear end frame of the spinning frame 1. A motor 42 is provided with a speed reduction mechanism (not shown), and can be reciprocally rotated in the normal and reverse directions by a predetermined number of rotations. A disc 43 is rigidly mounted on an output shaft 42*a* of the motor 42, the output shaft 42*a* being directed downward. A pair of pins 44*a* and 44*b* are mounted on the disc 43 at respective positions biased from the center of the disc 43. A lever 45*a*, turnably mounted pin 44*a* the pins 44, is turnably connected to an end portion of the slide bar 24 with a pin 27*a*, while another lever 45*b*, turnably mounted on pin 44*b*, is turnably connected to an end portion of the slide bar 24 with a pin 27*b*. In relation to the above-mentioned displacing mechanism 40, the relative arrangement of the roving guides 30 is designed to satisfy the following condition, i.e., an imaginary plane involves the axial centers of the front and back bobbin hangers 8 forming the above-mentioned pair of facing bobbin hangers "PB" are positioned to pass through a center of the intervening space between two adjacent roving guides 30 of the alignment thereof. The intervening space between the above-mentioned two adjacent roving guides 30 is changed by the displacing mechanism 40 such that the intervening space between two adjacent roving guides 30 a corresponding pair of facing bobbin hangers "PB", to which the roving bobbin exchange operation must be applied, is enlarged to a space L1 sufficient to guarantee a free passage of a full packaged roving bobbin FB therethrough, and the intervening space adjacent to the first-mentioned space, corresponding to the adjacent pair of facing bobbin hangers "PB" is narrowed to L2, which is smaller than the diameter of the full packaged roving bobbin FB but larger than the diameter of the almost exhausted roving bobbin SB. It must be note that the above-mentioned two adjacent intervening spaces L1 and L2 are defined by each of three roving guides 30 successively aligned along the alignment of the roving guides 30.

As explained hereinbefore, the above-mentioned creel mechanism is utilized for carrying out the roving bobbin exchange operation at each side of the ring spinning frame 1, wherein the two-step tapered arrangement of the roving bobbins is applied. Therefore, before starting the spinning operation, full packaged roving bobbins FB are suspended by a plurality of pairs of facing bobbin hangers "PB", alternately along the lengthwise direction of the spinning frame 1, and the almost half exhausted roving bobbins HB are suspended by the remaining plurality of pairs of facing bobbin hangers "PB". Until the above-mentioned half exhausted roving bobbins HB reach an almost exhausted condition, the intervening space between two adjacent roving guides 30, which involves an imaginary plane passing the axial centers of the front and back bobbin hangers 8 of the second mentioned pair of the facing bobbin hangers "PB", is enlarged to the above-mentioned space L1, and conversely, the intervening space between two adjacent roving guides 30, which is adjacent to the above-mentioned enlarged intervening space, is narrowed to L2 by relatively displacing the slide bars 24 and 25, which relative displacing motion of the slide bars 24 and 25 is created by the action of the displacing mechanism 40. When the above-mentioned almost half exhausted roving bobbins HB become almost exhausted condition, after the completion of the roving piecing operation and the threading operation of the respective rovings to the corresponding roving heads 32, the above-mentioned almost exhausted roving bobbins SB are taken from the respective bobbin hangers 8 and mounted on the corresponding bobbin hangers of a supplemental rail 12 of the spinning frame 1, and thereafter a pair of full packaged roving bobbins HB taken from the supplemental rail 12 are displaced to the creel portion of the spinning frame 1 from a direction perpendicular to the alignments of the bobbin hangers 8, thereby transfer the full packaged roving bobbins FB to the respective pairs of the facing bobbin hangers "PB" from which the almost exhausted roving bobbins have been taken. As explained hereinbefore, the intervening space involves the imaginary plane passing the axial centers of the bobbin hangers 8 of the above-mentioned pair of the facing bobbin hangers "PB", from which the almost exhausted roving bobbins 8 have been taken, is enlarged to L1, and therefore, the full packaged roving bobbin FB can be freely displaced through the above-mentioned enlarged intervening space and suspended by the corresponding back bobbin hanger 8, without damage to the outer surface thereof.

After completing the above-mentioned roving bobbin exchange operation, successively applied to all pairs of facing bobbin hangers "PB" from which the almost exhausted roving bobbins have been taken, and until a condition such that the half exhausted roving bobbins suspended by the remaining pairs of facing roving bobbins "PB" become almost exhausted condition, the intervening space involves the imaginary plane passing the axial centers of the front and back bobbin hangers 8 of the second mentioned pair of facing bobbin hangers "PB" is enlarged from the space L2 to L1, by a motion of the displacing mechanism 40 reverse to the previous motion mentioned above. When the roving bobbins suspended by the bobbin hangers 8 of the second mentioned pairs of facing bobbin hangers "PB" become almost exhausted condition, the roving bobbin exchange operation is carried out for the front and back bobbin hangers of the second mentioned pairs of facing bobbin hangers "PB" under a condition identical to the conditions for the above-mentioned operation applied to the first mentioned pairs of facing bobbin hangers "PB".

In the above-mentioned creel mechanism, the drive of the motor 42 of the displacing mechanism 40 is controlled by a control device (not shown) mounted on the spinning frame 1. That is, when the motor 42 receives a first electric signal, to be driven in the clockwise direction, the motor 42 drives the disc 43 in the clockwise direction, via the speed reduction mechanism, until the input of the first electric signal is stopped. On the other hand, when the motor 42 receives a second electric signal, to be driven in the counter-clockwise direction, the motor 42 drives the disc 43 in the counter-clockwise direction, via the speed reduction mechanism, until the input of the second electric signal is stopped. As already explained, the disc 43 is provided with a pair of pins 44*a* and 44*b*, and a pair of sensors 51 and 52 are mounted on the creel mechanism at the respective positions where the sensor 51 detects the pin 44*b* when the disc 43 is turned in the clockwise direction in FIG. 1, while the sensor 52 detects the pin 44*a* when the disc 43 is turned in the counter-clockwise direction in FIG. 1. The above-mentioned inputs of the first and second electric signals are issued through the above-mentioned control device a the respective desired times, for example, at each completion of the roving bobbin exchange operation, to create the desired intervening space between two adjacent roving guides 30 and carry out the next roving bobbin exchange operation. The above-mentioned input of the first electric signal is stopped by the control device when the sensor 51 detects the pin 44*b*, and the above-mentioned input of the second electric signal is stopped by the control device when the sensor 52 detects the pin 44*a*. Since the electric circuit having the above-mentioned function of the control device can be designed without any particular knowledge in the normal skilled person in the art, a detailed explanation of the control device is omitted.

In the above-mentioned embodiment shown in FIGS. 1, 2, 3, 4 and 5, each roving guide 30 is always positioned at a position biased from the intermediate position between two adjacent imaginary planes defined by two pairs of facing bobbin hangers 30, and when the intermediate space between two adjacent roving guides 30 is to be changed from the distance L2 to the distance L1, and vice versa, these sliding bars 24 and 25 are simultaneously displaced in the respective opposite directions each other, by turning the disc 43 as already explained. In a modification of the first embodiment, however, each roving guide 30 is always positioned at an intermediate position between two adjacent imaginary planes defined by two adjacent pairs of facing bobbin hangers "PB", and when the intervening space between two adjacent roving guides 30 is to be changed from the distance "Lo", not shown, which is identical to the pitch "p" defined hereinbefore, to the distance L1 or vice versa, the pair of roving guides, defined by a pair of facing roving bobbins "PB" for which the roving bobbin exchanging operation is to be carried out, are displaced to the respective directions to expand the intervening space therebetween to L1. Therefore, it must be recognized that the above-mentioned position of each roving guide 30 before the displacement motion thereof is a standby position which is maintained during the normal spinning operation. When the intervening space between two adjacent roving guides 30 defined by a pair of facing roving guides "PB" for which the roving bobbin exchange operation is required, is to be enlarged the slide bars 24 and 25 are displaced towards the respective directions from the respective standby positions, so that the intervening space therebetween can be changed from p to L1, and under the condition that the adjacent intervening space between two roving guides 30, one of which is one of two roving guides 30 of the first mentioned pair of facing roving bobbins "PB", is narrowed to L2. To displace the sliding bars 24 and 25 and create the above-mentioned relative displacement thereof, the disc 43 should be turned in such a way that, to enlarge the first mentioned intervening space, the disc 43 is turned from the standby condition in one direction, for example, the counter-clockwise direction, and stopped when the sensor 52 detects the pin 44*a*, and after completion of the roving bobbin exchange operation, the disc 43 is turned in the clockwise direction and returned to the standby condition. On the other hand, if the second mentioned space is to be enlarged, the disc 43 is turned from the standby condition in a direction reverse to the turning motion thereof mentioned above, for example, in the clockwise direction, and when the sensor 51 detects the pin 44*b*, the turning motion of the disc 43 is stopped so that the second mentioned intervening space is enlarged from the distance "p" to L1, and after completion of the roving bobbin exchange operation, the disc 43 is turned in the counterwise direction to be returned to the standby position.

Figure 7:
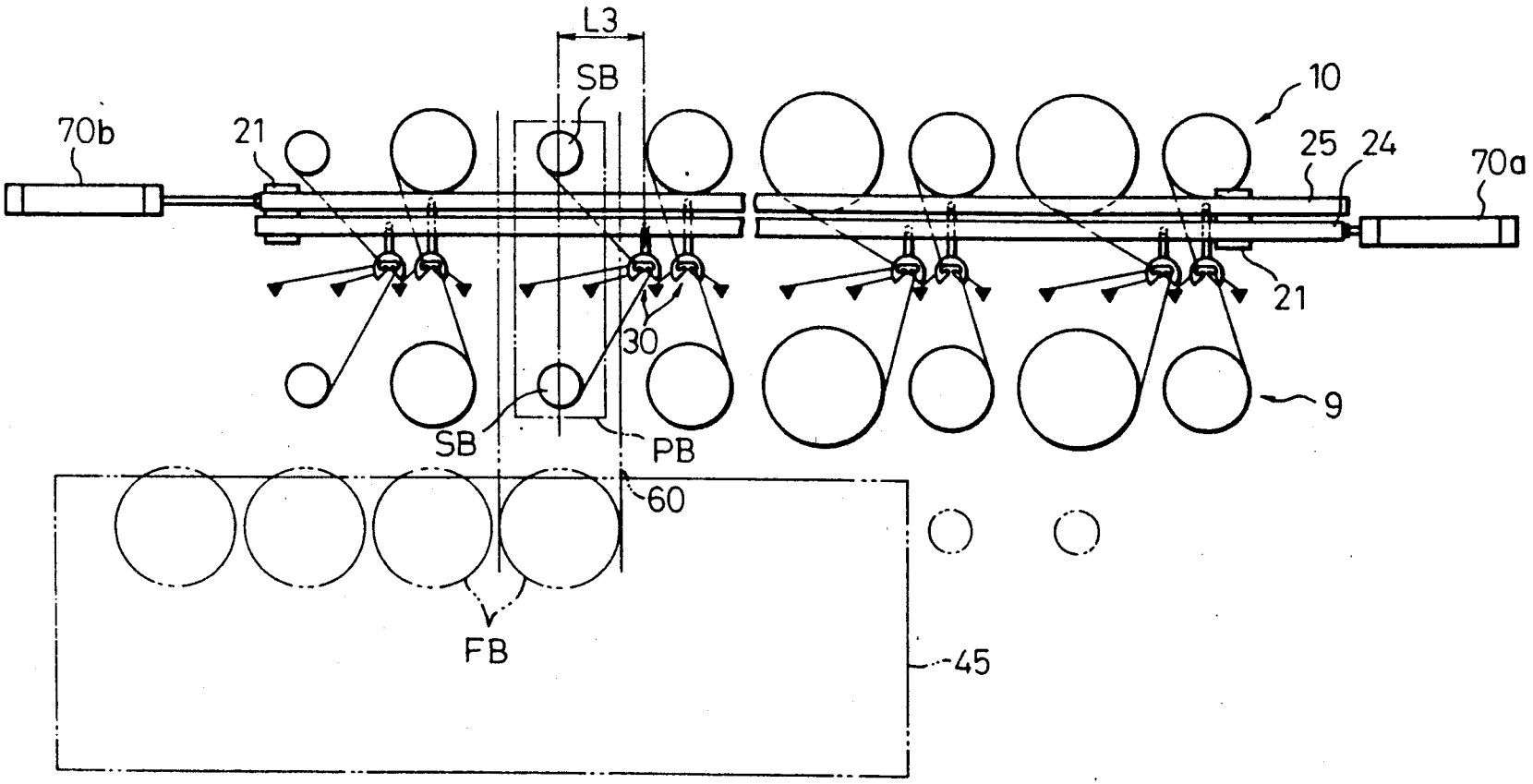
FIGS. 7 and 8 are plan views of the creel mechanism shown in FIG. 6, indicating the actuated condition thereof.
Figure 8:
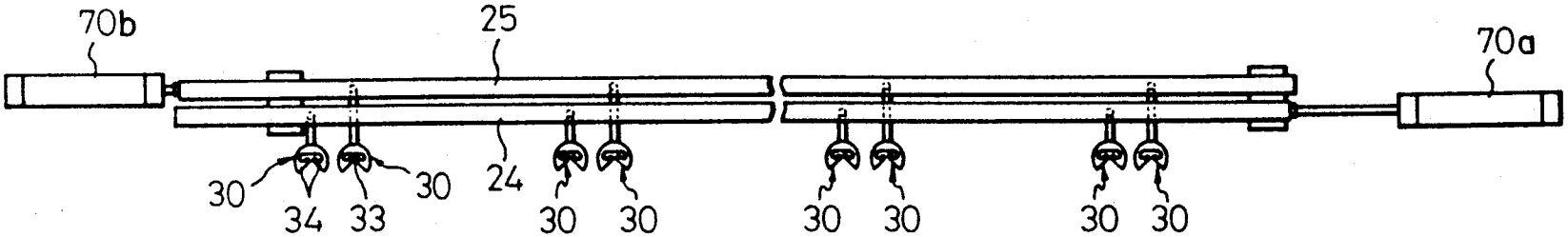

The second embodiment of the creel mechanism of the ring spinning frame, wherein the above-mentioned two-step taper arrangements of the roving bobbins is applied under conditions identical to those of the first embodiment of the present invention, is hereinafter explained in detail with reference to FIGS. 6, 7 and 8.

As it can be easily understood from these drawings, the relative positions of two adjacent roving guides 30 and a mechanism for displacing the slide bars 24 and 25 to create the respective space allowing the free passage of a full packaged roving bobbin FB to the back bobbin hanger 8 to which the roving bobbin exchange operation is to be applied, are different from the first embodiment of the present invention.

Figure 6:
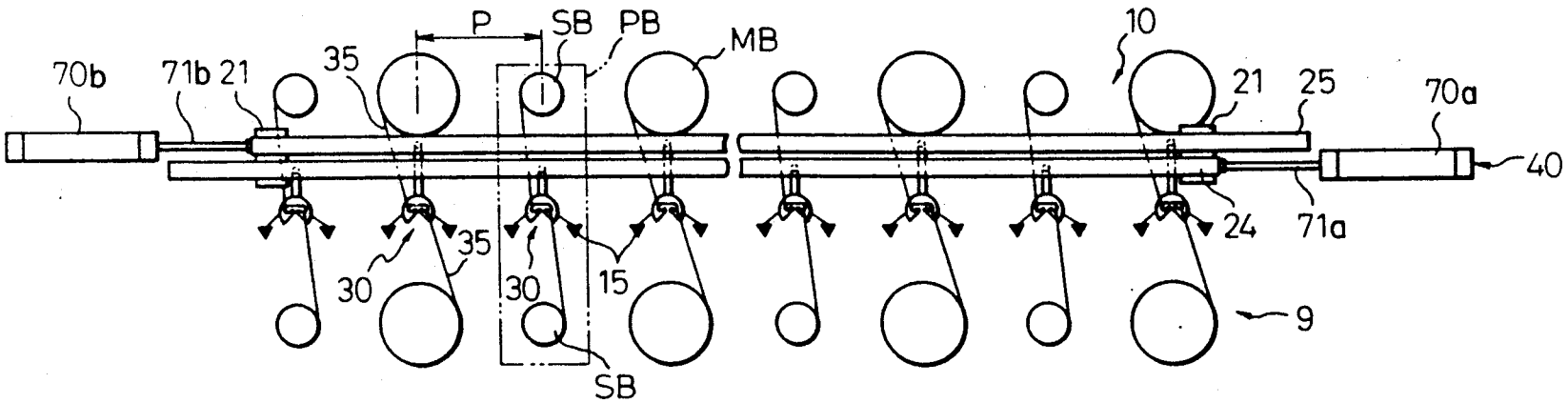
FIG. 6 is a plan view of another embodiment of the creel mechanism according to the present invention, indicating a standby condition thereof.

As shown in FIG. 6, the roving guides 30 are alternately connected to the slide bars 24 and 25 such that, during the time between the successive roving bobbin exchange operations, each roving guides 30 is at a standby position such that the center thereof is on an imaginary plane defined by the axial centers of the front bobbin hanger and the back bobbin hanger of a pair of facing bobbin hangers "PB". Therefore, the pitch of the arrangement of the roving guides 30 in the standby condition is identical to the pitch between two adjacent imaginary planes defined by the respective pairs of front and back bobbin hangers 8 which form two adjacent pairs of facing bobbin hangers "PB" respectively.

The slide bar 24 is connected at one end thereof to a pneumatic cylinder 70*a*, by way of a piston 71*a* thereof, and the slide bar 25 is connected at one end to another pneumatic cylinder 70*b*, by way of a piston 71*b*. These pneumatic cylinders 70*a* and 70*b* form the displacing mechanism 40, and the ends of the slide bars 24 and 25 connected to the displacing mechanism 40 are positioned at both sides of the spinning frame 1. The pneumatic cylinders 70*a* and 70*b* displace the respective slide bars 24 and 25 in the following condition. Namely, before the roving bobbins suspended by the respective front and back bobbin hangers 8 of the first group pairs of facing bobbin hangers "PB" become almost exhausted condition, each roving guide 30 connected to the slide bar 24 is displaced to a corresponding adjacent roving guide 30 connected to the slide bar 25, which is at the standby position, by displacing the slide bar 24 for a predetermined distance L3, as shown in FIG. 7, sufficient to create a space to allow the free passage of a full packaged roving bobbin FB towards the corresponding back bobbin hangers 8 for which the roving bobbin exchange operation is required, and before the roving bobbins supported by the front and back bobbin hangers 8 of the second group pairs of facing bobbin hangers "PB" become almost exhausted condition, each roving guide 30 connected to the slide bar 25 is displaced to a corresponding adjacent roving guide 30 connected to the slide bar 24, which is at the standby position, by displacing the slide bar 25 for the above-mentioned distance L3 in a direction opposite to the direction of the first-mentioned displacement of the slide bar 24, and after completion of the respective roving bobbin exchange operations, the slide bars 24 and 25 are displaced to the standby positions, respectively, by the action of the displacing mechanism 40. Accordingly, the stroke of the piston rod 71*a* of the pneumatic cylinder 70*a* and that of the piston rod 71*b* of the pneumatic cylinder 70*b* are defined to satisfy the above-mentioned conditions. To ensure a smooth operation of the displacing mechanism 40, a known pneumatic cylinder provided with a speed controller, and a known pneumatic cylinder provided with a hydro-check unit, can be used for the displacing mechanism 40.

It must be noted that such smooth operation of the displacement mechanism creates smooth and slow displacement of roving guides 30 so that any possible breakage of rovings can be prevented.

As explained hereinbefore, the displacement motions of the slide bars 24 and 25 are carried out alternately in relation to the roving bobbin exchange operation applied to the first group pairs of facing bobbin hangers "PB" and that operation applied to second group pairs of facing bobbin hangers "PB" of the ring spinning frame 1.

The third embodiment of the present invention is hereinafter explained in detail with reference to the drawings of FIGS. 9A, 9B, 10 and 11.

Figure 9A:
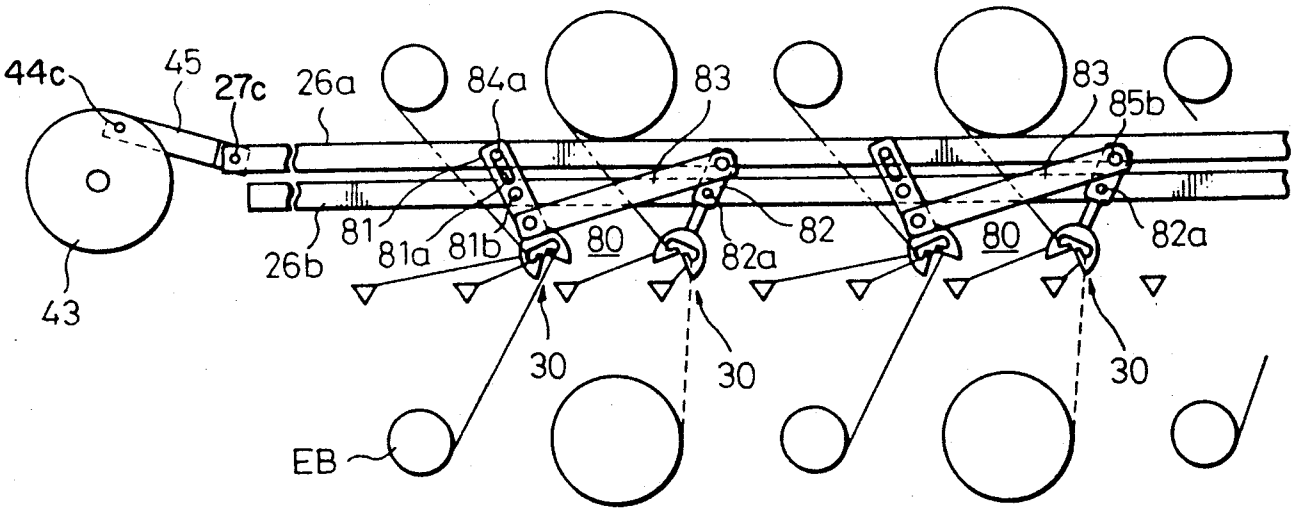
FIG. 9A is a plan view of further modified embodiment of the creel mechanism according to the present invention.
Figure 9B:
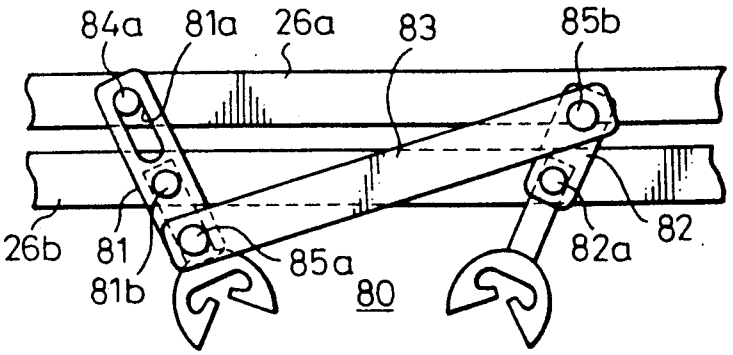
FIG. 9B is an enlarged plan view of a unit link motion mechanism shown in FIG. 9A.
Figure 10:
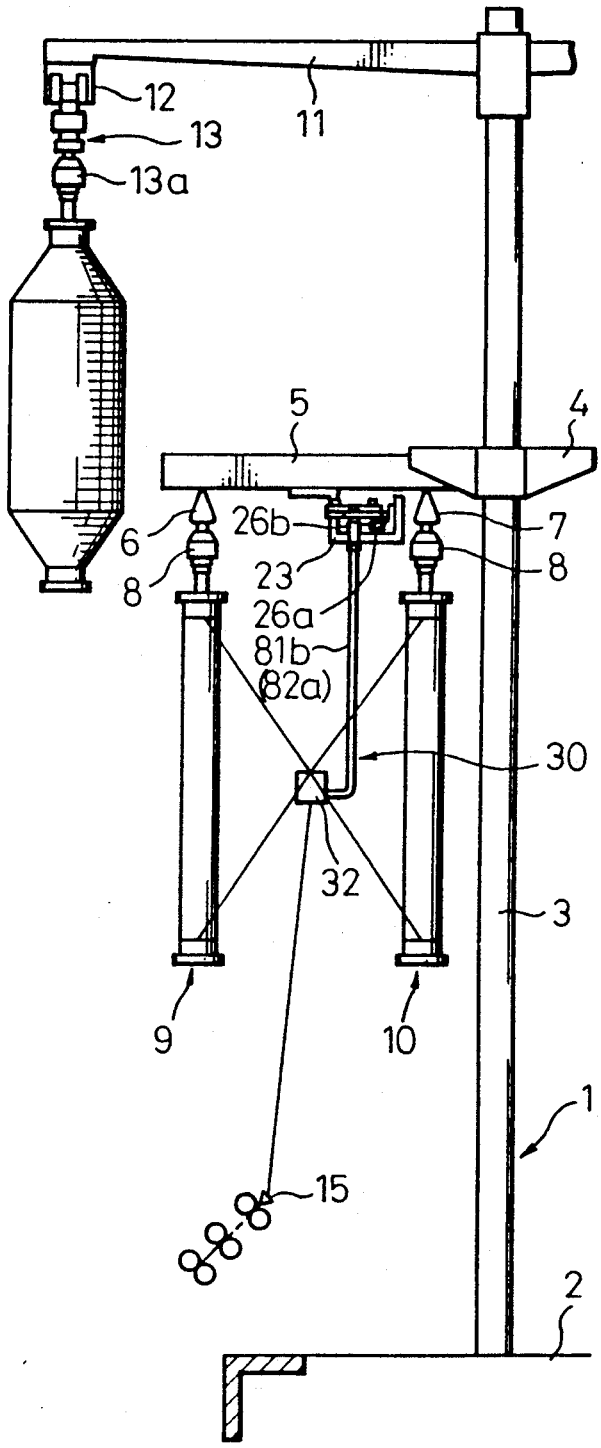
FIG. 10 is a longitudinal cross sectional view of the creel mechanism shown in FIG. 9A.
Figure 11:
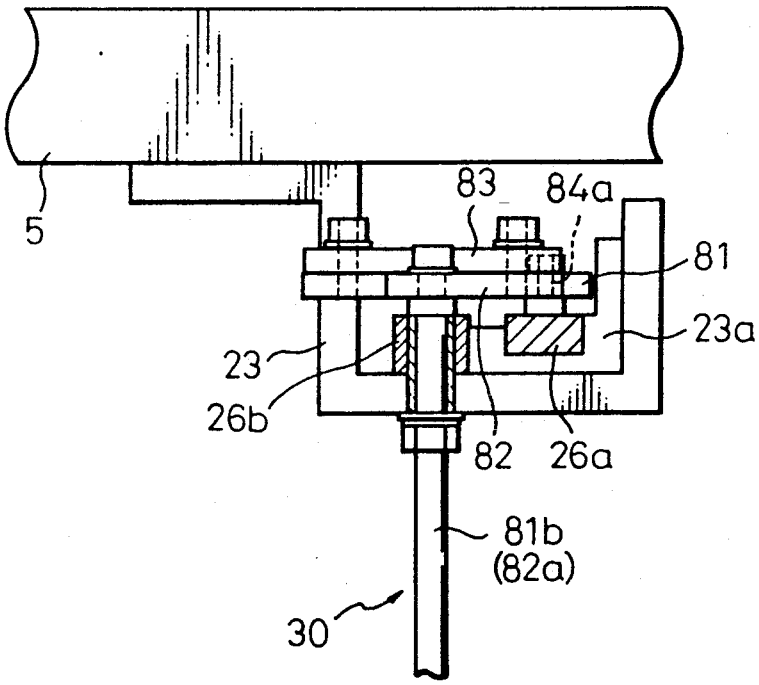
FIG. 11 is partly omitted cross sectional side view of a ring spinning frame utilizing the creel mechanism shown in FIG. 9A.

The creel mechanism is provided with a slide bar 26*a*, extended along the lengthwise center line of the spinning frame 1, slidably supported by the slide bar supporting brackets 23*a* having a similar construction and function to the slide bar supporting bracket 23 of the first embodiment of the present invention, and a stationary bar 26*b* extended along the slide bar 26*a* and stationarily supported by the slide bar supporting brackets 23*a*, and a displacing mechanism 40 having a mechanism identical to that of the first embodiment of the present invention, except for the disc 43. The disc 43 is provided with a single pin 44*c* and a connecting bar 45 is turnably connected at one end thereof to the disc 43 by the pin 44*c*, and the other end of the connecting bar 45 is turnably connected to one end of the slide bar 26*a* by a pin 27*c*. Therefore, the slide motion of the slide bar 26*a* is created by the turning motion of the disc, in a condition identical to that of the first embodiment of the present invention. In this creel mechanism, the roving guide alignment is formed by a plurality of pairs of two adjacent roving guides 30 successively arranged along the slide bar 26*a*. Each pair of the roving guides 30 is mounted on a link mechanism 80 actuated by the relative displacement of the slide bar 26*a* to the stationary bar 26*b*, whereby the intervening space between two adjacent roving guides 30 of each pair thereof can be changed by the motion of the link mechanism 80. As shown in FIGS. 9A, 9B, the link mechanism 80 is formed by a first link bar 81, a second link bar 82, and the third link bar 83 turnably connected to the first link bar 81 and second link bar 82 by a pair of pins 85*a*, 85*b* such one free end thereof is turnably connected to an intermediate portion of the first link bar 81 and another end portion thereof is turnably connected to a free end portion of the second link bar 82. The first link bar 81 is provided with a slit 81*a* formed at a free end portion thereof, and is further turnably connected to the slide bar 26*a* by a pin 84*a* rigidly mounted on the slide bar 26*a*, in a condition such that the pin 84*a* is slidably inserted to the slit 81*a*. The first link bar 81 is further provided with a downwardly extended vertical rod 81*b* secured thereto at an intermediate portion between the slit 81*a* and the pin 85*a*, and one of the roving guides 30 is secured to a bottom end of the vertical rod 81*b* in parallel to the first link bar 81. On the other hand, the free end separated from the other end, to which the third link bar 83 is pivotally connected by the connecting pin 85*b*, is rigidly mounted on a downwardly extended vertical rod 82*a* which is turnably mounted on the stationary bar 26*b*, and the other of the roving guides 30 is secured to a bottom end of the vertical rod 82*a* in parallel to the second link bar 82. The positions of these two roving guide 30 are, of course, fixed at an identical level. In the above-mentioned link motion mechanism, the setting of the position of the pin 84*a* can be changed.

Since, in the creel mechanism according to the third embodiment of the present invention, the displacing mechanism 40 is constructed to cooperate with the above-mentioned slide bar 26*a*, the stationary bar 26*b*, and the link motion mechanism 80 mentioned above, the intervening space between two adjacent roving guides 30 of each pair of the roving guides can be changed by the displacement of the slide bar 26*a* between the distance L1 and L2 explained in the explanation of the first embodiment of the present invention, which is carried out by the turning of the disc 43 under the same condition as in the first embodiment of the present invention. On the other hand, to vary the intervening space between two adjacent roving guides 30, one of which is one of a pair of roving guides 30 and the other is one of an adjacent pair of roving guides, to make it identical to the above-mentioned change of the intervening space between two roving guides 30 of each pair of roving guide, the size of the link bars 81, 82 and 83, the position at which the first link bar 81 is connected to the third link bar 83, the position at which the first link bar 81 is connected to the slide bar 26*a*, the position at which the second link bar 82 is connected to the stationary bar 26*b*, are predetermined.

In the above-mentioned three embodiments of the creel mechanism according to the present invention, the following modifications can be made.

That is, in the first and second embodiments, the slide bars 24 and 25 are slidably mounted on the creel bar brackets 5 and the roving guides 30 are alternately suspended by the slide bars 24 and 25, respectively, but if these slide bars 24 and 25 will not disturb the roving exchange operation, these slide bars 24, 25 can be arranged at respective other positions in the creel portion where the above-mentioned conditions can be satisfied, for example, at a position in the proximity of the creel pillars 3, and each vertical supporting rod 31 rigidly mounted on the respective slide bars 24, 25 in an upright condition.

In the second embodiment of the present invention, the pneumatic cylinders 70*a*, 79*b* are arranged at both ends of the spinning frame 1, but these pneumatic cylinders 70*a* and 70*b* can be arranged at the same end of the spinning frame 1. Any type of displacing mechanism having the function of reciprocally displacing the slide bars 24, 25 can be utilized.

In the above-mentioned creel mechanism, the intervening space between two adjacent roving guides 30 alternately connected to the side bars 24 and 25 is simultaneously changed, but if the roving bobbin exchange operation is carried out by stepwise operations successively applied to groups of spindles from one end side to the other end side of the spinning frame 1, the changing of the intervening space between two adjacent roving guides is also carried out in a condition such that a group of the above-mentioned intervening spaces defined by roving guides, from which the respective rovings are supplied to the respective draft parts corresponding to each one of the above-mentioned groups of spindles, are simultaneously changed, before carrying out the roving bobbin exchange operation for the corresponding group of spindles, and such a group operation of changing the intervening spaces is successively carried out in relation to the above-mentioned stepwise roving bobbin exchange operation. The motion of the roving guides 30 belonging to each group is controlled by an exclusive displacing mechanism having a construction and function identical to those of the first or second embodiment of the present invention.

In the third embodiment of the present invention, if each pair of roving guides 30 is utilized to guide the respective roving from the respective roving bobbins supported by the front and back bobbin hangers 30, as in the first embodiment, the above-mentioned unit link motion mechanism is applied only to the draft parts of each side of the spinning frame, except for draft parts positioned in the proximity of the gear end and outer end of the spinning frame, and therefore, two stationary roving guides are mounted on the creel mechanism at the respective positions corresponding to these draft parts.

As explained hereinbefore, since the intervening space between two adjacent roving guides is enlarged to allow a free passage of a full packaged roving bobbin, until the roving bobbin exchange operation is required, when this bobbin is introduced to the corresponding bobbin hanger of the back alignment thereof when carrying out the roving bobbin exchange operation, any possible damage created by contact with the roving guide or guides can be effectively prevented. Moreover, the delicate arrangement of the roving guides in the creel portion of the spinning frame and the limitation of the size of the full packaged roving bobbin, as required in the conventional ring spinning frame, can be ignored. Also, an advantage of the present invention is that the operation of changing the intervening space between two adjacent roving guides need not be carried out in a very restricted time, because this operation is allowed to be completed before starting the corresponding roving bobbin exchange operation.

We claim:

1. In a creel of a ring spinning frame provided with a plurality of draft parts arranged at each side thereof, a plurality of front and back bobbin hangers for holding respective roving bobbins, arranged in respective front and back alignments thereof and in parallel to the lengthwise direction of said spinning frame, a plurality of roving guides arranged in an alignment along the lengthwise direction of said spinning frame at respective intermediate positions between said two alignments of front and back bobbin hangers, each roving guide being provided with a pair of guide elements for guiding respective rovings fed from corresponding roving bobbins mounted on a pair of said front and back bobbin hangers to corresponding draft parts, wherein an imaginary plane defined by axial centers of a front bobbin hanger and a corresponding one of said back bobbin hangers is perpendicular to the lengthwise direction of said spinning frame;

a creel mechanism provided with displaceable roving guides comprising a pair of supporting members arranged in said creel portion of said spinning frame;

a first slide bar slidably supported by said supporting members and extended along said alignment of roving guides;

a second slide bar slidably supported by said supporting members in parallel to an entire length of said first slide bar;

a first group of said roving guides supported by said first slide bar having constant pitch between adjacent roving guides of said first group so that an alignment of said first group of roving guides is formed along the lengthwise direction of said first slide bar;

a second group of said roving guides supported by said second slide bar having a pitch identical to said constant pitch of said first group of roving guides along the lengthwise direction of said second slide bar;

said first and second groups of roving guides being arranged in a combined arrangement along the lengthwise direction of said spinning frame such that a plurality of larger intervening spaces in the lengthwise direction of said spinning frame is formed between some adjacent roving guides, which allows free passage of a roving bobbin of full packaged condition and, a plurality of smaller intervening spaces in the lengthwise direction of said spinning frame is formed between some adjacent roving guides, which allows free passage of at least a roving bobbin of an almost exhausted condition; said larger and smaller intervening spaces being formed alternately between adjacent roving guides of said combined arrangement of said roving guides, along said lengthwise direction of said spinning frame, a mechanism for changing said larger intervening spaces between adjacent roving guides of said combined arrangement of roving guides into smaller intervening spaces, while changing said smaller intervening spaces of said combined arrangement of roving guides into larger intervening spaces, whereby said larger intervening spaces are changed into smaller intervening spaces and said smaller intervening spaces are changed into larger intervening spaces, each time said mechanism is actuated.

2. An improved creel mechanism according to claim 1, wherein said mechanism for relatively displacing said first and second groups of roving guides comprises a motor able to be reciprocally turned in a normal direction and in a direction reverse to said normal direction, said motor being provided with a speed reduction means; a disc coaxially secured to a motor shaft of said motor; a pair of connecting pins mounted on said disc at a predetermined angular distance; a first connecting rod turnably mounted at one end thereof on one of said pins and a second connecting rod turnably mounted on another one of said pins, whereby said first slide rod is pivotally connected at one free end thereof to another end of said first connecting rod, and said second slide bar is pivotally connected to another end of said second connecting rod; a pair of sensing pins rigidly mounted on said disc, with a predetermined angular distance therebetween; a pair of sensors disposed respectively at positions for detecting a corresponding one of said sensing pins; an electric control means for actuating a rotating motion of said motor, and for stopping a driving of said motor when either one of said sensors detects a corresponding one of said sensing pins, wherein relative positions of said sensing pins in relation to the respective positions of said connecting pins mounted on said disc are designed to satisfy the condition of creating said enlarged intervening space between two adjacent roving guides and said narrowed intervening space between two adjacent roving guides alternately along said alignment of roving guides, when said motor is driven in either of said rotating directions.

3. An improved creel mechanism according to claim 1, wherein said mechanism for relatively displacing said first and second groups of roving guides comprises a pair of pneumatic cylinders, each provided with a piston rod having a predetermined stroke, wherein one free end of said first slide bar is connected to one of said pneumatic cylinders by way of said piston rod, and one free end of said second slide bar is connected to another of said pneumatic cylinders by way of said connecting rod, said predetermined stroke of each of said pneumatic cylinders is designed to satisfy the condition of creating said enlarged intervening space between two adjacent roving guides and said narrowed intervened space between two adjacent roving guides, alternately along said alignment of roving guides.

4. An improved creel mechanism according to claim 1, wherein said mechanism for relatively displacing said first and second groups of roving guides, comprises a stationary element secured to said second slide bar, whereby said second slide bar is always maintained in a stationary condition; a motor able to be reciprocally turned in a normal direction and a direction reverse to said normal direction, said motor being provided with a speed reduction means, a disc coaxially secured to a motor shaft of said motor; a connecting pin mounted on said disc; a connecting rod turnably mounted at one end thereof on said pin, and the other end thereof is pivotally connected to a free end of said first slide bar; a sensing pin secured to said disc and a sensor disposed at said disc for detecting said sensing pin; an electric control means for actuating a rotating motion of said motor and for stopping said motor when said sensor detects said sensing pin, a plurality of intermediate link motion mechanisms arranged along said first and second slide bars, each of said intermediate link bar mechanisms comprising a first link bar and a second link bar, and a third link bar pivotally connected at both ends thereof with a free end of said first link bar and a free end of said second link bar respectively, said first link bar being provided with a slit formed at another end thereof and pivoted with a first downwardly extended vertical rod secured to an upper end thereof at an intermediate portion thereof between said slit and a pivotally connected portion of said first link bar with said third link bar, said second link bar being provided with a second downwardly extended vertical rod secured at an upper end thereof to another end separated from a pivotally connected portion of said second link bar with said third link bar, said first link bar being turnably connected to said first slide bar by a pin secured to said first slide bar in a condition such that said pin is inserted into said slit, and said second vertical rod being turnably supported by said second slide bar, one of two adjacent roving guides being horizontally secured to a bottom end of said first vertical rod, and another one of said two adjacent roving guides being horizontally secured to a bottom end of said second vertical bar at a level identical to said roving guide connected to said first vertical rod; wherein dimensions of said first, second and third link bar and their connection relationship are designed to satisfy the condition of creating said enlarged intervening space between two adjacent roving guides and said narrowed intervening space between two adjacent roving guides, alternately along said alignment of roving guides, when said motor is driven in either one of said rotating directions.

5. An improved creel mechanism according to claim 1, wherein said means for relatively displacing said first group of roving guides and said second group of roving guide is provided with a speed reduction mechanism.

* * * * *